US008646523B2

(12) United States Patent
Huang et al.

(10) Patent No.: US 8,646,523 B2
(45) Date of Patent: Feb. 11, 2014

(54) METHOD AND MATERIALS FOR PROPPANT FLOW CONTROL WITH TELESCOPING FLOW CONDUIT TECHNOLOGY

(75) Inventors: Tianping Huang, Spring, TX (US); Richard YingQing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 475 days.

(21) Appl. No.: 12/814,630

(22) Filed: Jun. 14, 2010

(65) Prior Publication Data

US 2011/0220362 A1 Sep. 15, 2011

Related U.S. Application Data

(63) Continuation-in-part of application No. 12/723,983, filed on Mar. 15, 2010.

(51) Int. Cl.
*E21B 34/10* (2006.01)
*E21B 43/26* (2006.01)

(52) U.S. Cl.
USPC ..... 166/100; 166/242.7; 166/374; 166/317

(58) Field of Classification Search
USPC ..... 166/242.7, 374, 381, 100, 317
See application file for complete search history.

(56) References Cited

U.S. PATENT DOCUMENTS

| | | | | |
|---|---|---|---|---|
| 4,285,398 | A * | 8/1981 | Zandmer et al. | 166/100 |
| 5,425,424 | A * | 6/1995 | Reinhardt et al. | 166/291 |
| 6,805,198 | B2 | 10/2004 | Huang et al. | |
| 7,461,699 | B2 | 12/2008 | Richard et al. | |
| 7,527,103 | B2 | 5/2009 | Huang et al. | |
| 7,703,520 | B2 * | 4/2010 | Dusterhoft | 166/278 |
| 8,079,416 | B2 * | 12/2011 | Parker | 166/285 |
| 2003/0029621 | A1 * | 2/2003 | Haynes | 166/381 |
| 2005/0284633 | A1 * | 12/2005 | Richard | 166/278 |
| 2008/0035349 | A1 * | 2/2008 | Richard | 166/308.1 |
| 2008/0296024 | A1 * | 12/2008 | Huang et al. | 166/311 |

OTHER PUBLICATIONS

R. Weinberger, et al., "Tensile Properties of Rocks in Four-Point Beam Tests Under Confining Pressure," Rock Mechanics, 1994, pp. 435-442.

T. Huang, et al., "Reaction Rate and Fluid Loss: The Keys to Wormhole Initiation and Propagation in Carbonate Acidizing," SPE 65400, SPE International Symposium on Oilfield Chemistry, Feb. 18-21, 1997, vol. 5, No. 3, pp. 287-292.

(Continued)

*Primary Examiner* — Giovanna Wright
*Assistant Examiner* — Catherine Loikith
(74) *Attorney, Agent, or Firm* — Mossman, Kumar & Tyler, P.C.

(57) ABSTRACT

Porous objects, such as porous balls, may be employed within telescoping devices to control proppant flowback through a completed well during production. The telescoping devices may connect a reservoir face to a production liner without perforating. Acid-soluble plugs initially disposed within the telescoping devices may provide enough resistance to enable the telescoping devices to extend out from the production liner under hydraulic pressure. The plugs may then be dissolved in an acidic solution, which may also be used as the hydraulic extension fluid. After the plugs are substantially removed from the telescoping devices, the reservoir may be hydraulically fractured using standard fracturing processes. The porous balls may then be inserted into the telescoping devices to block proppant used in the fracturing process from flowing out of the reservoir with the production fluids.

23 Claims, 6 Drawing Sheets

(56) References Cited

OTHER PUBLICATIONS

O. Katz, et al., "Evaluation of Mechanical Rock Properties Using a Schmidt Hammer," International Journal of Rock Mechanics and Mining Science, 2000, vol. 37, pp. 723-728.

T. Huang, et al., "Carbonate Matrix Acidizing Fluids at High Temperatures: Acetic Acid, Chelating Agents or Long-Chained Carboxylic Acids," SPE 82268, SPE European Formation Damage Conference, The Hague, The Netherlands, May 13-14, 2003.

P. Nguyen, et al., "Remediation of Production Loss Due to Proppant Flowback in Existing Wellbores," SPE Russian Oil and Gas Technical Conference and Exhibition, SPE 102626, Moscow, Russia, Oct. 3-6, 2006.

P. Nguyen, et al., "Remediation of Proppant Flowback—Laboratory and Field Studies," European Formation Damage Conference, SPE 106108, Scheveningen, The Netherlands, May 30-Jun. 1, 2007.

J. Trela, et al., "Controlling Proppant Flowback to Maintain Fracture Conductivity and Minimize Workovers: Lessons Learned from 1,500 Fracturing Treatments," SPE Int'l Symposium and Exhibition on Formation Damage Control, SPE 112461, Lafayette, Louisiana, Feb. 13-15, 2008.

* cited by examiner

METHOD AND MATERIALS FOR PROPPANT FLOW CONTROL WITH TELESCOPING FLOW CONDUIT TECHNOLOGY

CROSS-REFERENCE TO RELATED APPLICATIONS

This application is a continuation-in-part of U.S. Ser. No. 12/723,983, filed Mar. 15, 2010.

TECHNICAL FIELD

The present invention relates to methods and compositions for controlling proppant flow through a wellbore, and more particularly relates, in one embodiment, to methods and compositions for controlling proppant flow through a wellbore after proppant fracturing.

BACKGROUND

There are a number of procedures and applications that involve the formation of a temporary seal or plug while other steps or processes are performed, where the seal or plug must be later removed. Often such seals or plugs are provided to temporarily block a flow pathway or inhibit the movement of fluids or other materials, such as flowable particulates, in a particular direction for a short period of time, when later movement or flow is desirable.

The recovery of hydrocarbons from subterranean formations often involves applications and/or procedures employing coatings or plugs. In instances where operations must be conducted at remote locations, namely deep within the earth, equipment and materials can only be manipulated at a distance. One such operation concerns perforating and/or well completion operations incorporating filter cakes and the like as temporary coatings.

Generally, perforating a well involves a special gun that shoots several relatively small holes in the casing. The holes are formed in the side of the casing opposite the producing zone. These perforations, or communication tunnels, pierce the casing or liner and the cement around the casing or liner. The perforations go through the casing and the cement and a short distance into the producing formation. Formations fluids, which include oil and gas, flow through these perforations and into the well.

The most common perforating gun uses shaped charges, similar to those used in armor-piercing shells. A high-speed, high-pressure jet penetrates the steel casing, the cement, and the formation next to the cement. Other perforating methods include bullet perforating, abrasive jetting, or high-pressure fluid jetting.

The characteristics and placement of the communication tunnels can have significant influence on the productivity of the well. Technology has been developed which eliminates the need for perforating guns and enables significantly more controlled perforation through the use of fluid conduits installed within casings. These fluid conduits may be extended out from the casing to contact a formation wall, thereby forming "perforations" at desired locations along the length of the casing. Temporary plugs in the conduits form fluid barriers, and the conduits are pushed out from the casing via fluid pressure. The plugs may be made of a porous filter structure on which a degradable barrier material is coated. After the fluid conduits are extended, the degradable material may be removed, thereby allowing the flow of fluids through the filter structure. This technology, known as TELEPERF™ from Baker Hughes Inc, is described in more detail in U.S. Pat. Nos. 7,527,103 and 7,461,699, each incorporated by reference herein its entirety.

In some instances, it may be necessary or desirable to fracture a formation to enable or promote the flow of fluids therethrough. For example, in low-permeability reservoirs, it may be beneficial to fracture the well formation and inject proppants into the fractures to stimulate the flow of fluids (such as oil, gas, water, and the like) through the formation. When hydraulic fracturing is performed, the viscous fracturing fluids mixed with proppant are flowed into the formation through the casing and associated perforations. However, filters in the above-described TELEPERF™ devices may obstruct or impede the high-viscosity fluids and proppants utilized in hydraulic fracturing from entering the formation.

Accordingly, hydraulic fracturing may be accomplished in TELEPERF™ devices by temporarily plugging the telescoping conduits to inhibit the flow of fluid therethrough. Hydraulic pressure telescopes the flow conduits outward, and the temporary plugs may then be removed from the flow conduits via an acidic solution. High-viscosity fluids and proppants may then be injected to fracture the subterranean reservoir. This technology, known as TELEFRAC™ from Baker Hughes Inc, is described in more detail in U.S. patent application Ser. No. 12/723,983, which is herein incorporated by reference its entirety.

Although the TELEFRAC™ method described above enables proppant fracturing through the TELEPERF™ tunnels, the system does not provide for a filter structure through which the formation fluids may be returned to the well surface. It may be desirable to filter the formation fluids in order to control proppant flow back into the wellbore. Ensuring that the proppant remains in the fracture will increase the fracture integrity in the near wellbore region and maintain higher productivity that results from well fracturing.

SUMMARY

There is provided, in one non-limiting form, a method for extracting well fluids from a fractured hydrocarbon formation while controlling the flow of proppant back through the wellbore. The hydrocarbon formation has disposed within it a pipe having orifices through at least a region of its wall, and telescoping flow conduits, pathways, channels, passages, outlets, or the like situated within the orifices in a retracted position within the pipe. The telescoping flow conduits contain porous objects disposed within them to control the flow of proppant and sand from the formation. The hydraulic fracturing method includes extending the telescoping flow conduits radially outward from the pipe in the direction of the wellbore wall via an extension fluid. Hydraulic fracturing fluid may then be injected into the subterranean reservoir via the pipe and the telescoping flow conduits. The porous objects are then injected into the telescoping flow conduits to control the flow of proppant and formation sand into the wellbore during production of the formation.

In another non-limiting embodiment of the present disclosure, a system or apparatus may be provided for use in well completions. The system may include a pipe, such as a conductor pipe, a casing, a tubing, a liner, or the like. Through the wall of the pipe are disposed telescoping flow conduits made of at least two sleeves. In one exemplary embodiment, the first sleeve is attached to the pipe wall, and the second sleeve is disposed within the first sleeve and is moveable relative to the first sleeve. The second sleeve may contain an acid-soluble plug which temporarily blocks, inhibits, or prevents flow through the sleeve. The inhibited flow enables the second sleeve to be moved relative to the first sleeve via hydraulic pressure. After the plug is dissolved using an acidic solution, a porous ball may be inserted into the second sleeve to serve as a filter or a sand control screen during production of the well.

DETAILED DESCRIPTION

In accordance with a present embodiment, an oil well casing or liner may contain pre-formed perforations, or holes, therethrough. Further, installed in each perforation may be a moveable fluid conduit or pathway which enables fluid communication between the interior and the exterior of the casing or liner. For example, the fluid conduit may be several generally cylindrical conduits arranged coaxially with a limited range of motion relative to each other along the commonly shared axis, e.g. in a telescoping configuration.

The flow conduits or pathways may further contain temporary plugs which inhibit or prevent the flow of fluid through the conduits. The moveable flow conduits or pathways may be telescoped out from the casing or liner into the wellbore annulus via fluid pressure within the casing or liner. That is, as fluid is pumped into the casing, the temporary plugs inhibit the fluid from exiting the casing via the flow conduits. Rather, as the pressure inside the casing increases, the flow conduits are pushed outward from the casing. Optimally, the flow conduits contact the wellbore wall, thereby forming a flow pathway through the annulus from the interior of the casing to the formation. In this manner, the described structure may be used as a completion tubular to avoid using a cementing and perforation process. After the assembly is in place across the producing zone location, the temporary plugs may be dissolved using an acidic solution.

A hydraulic fracturing fluid may then be pumped through the casing, out the flow conduits, and into the formation. The fluid may fracture the formation, thereby increasing its permeability and stimulating production. In addition, proppants may be used in the fluid to keep the fracture open after the procedure has been completed. In an exemplary embodiment, porous media may then be disposed within the flow conduits to inhibit return of the proppants during production of the formation.

Figure 1:
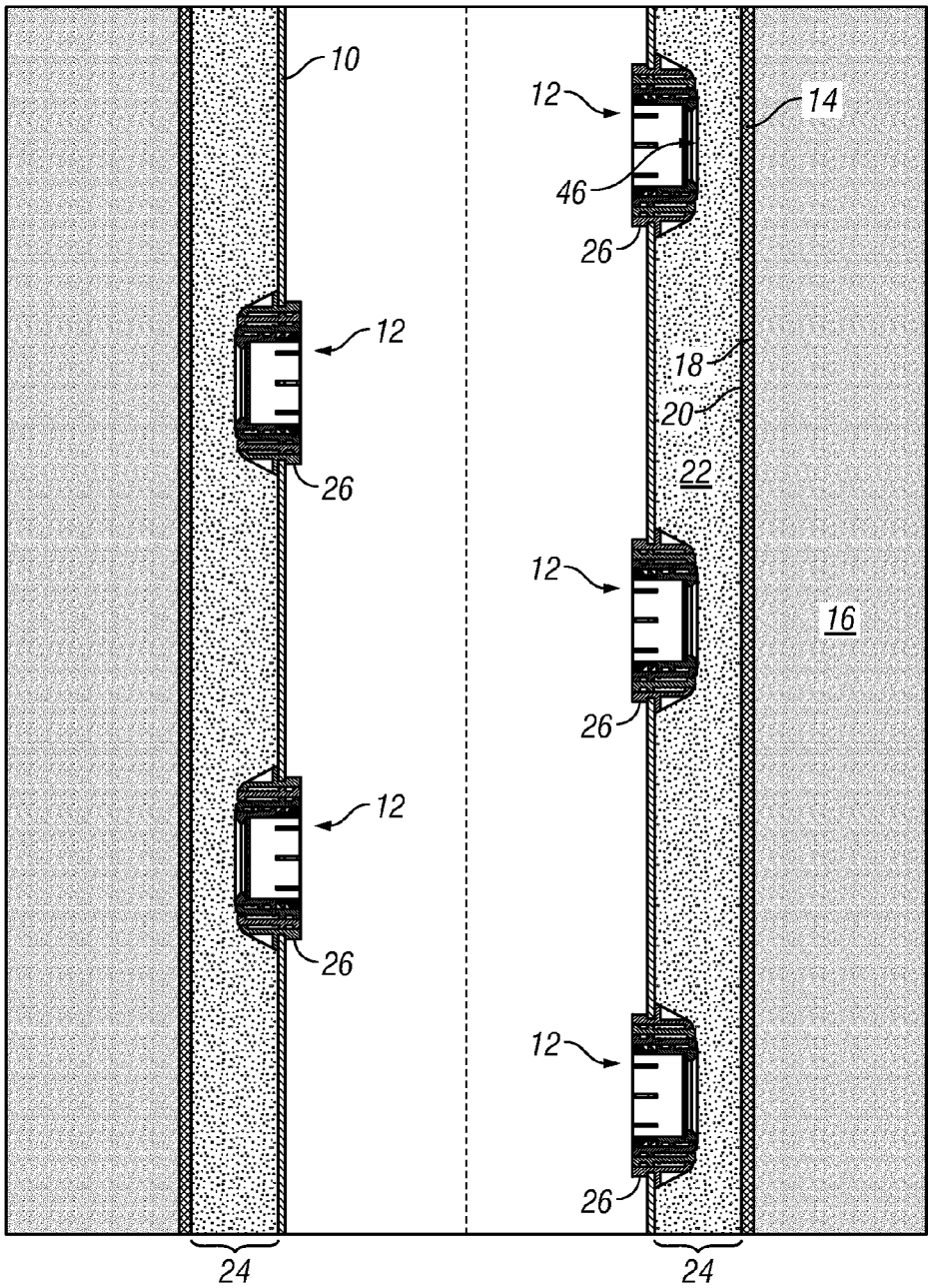
FIG. 1 is a cross-section schematic view of a wellbore having an oil well casing or tubing disposed therein which has a plurality of telescoping conduits therein, each in a retracted position in an orifice in the casing and having a dissolvable plug therein

The well completion system will now be described more specifically with respect to the figures, where in FIG. 1 there is shown a cross-section of a vertically oriented, cylindrical casing or liner 10 having a plurality of orifices 12 therethrough. The orifices 12 may be created by machining or other suitable technique. The casing 10 is placed in a borehole or wellbore 14 through a subterranean reservoir 16. The subterranean reservoir 16 may be a flow source from which gas and/or oil is extracted or, alternatively, a flow target into which gas or water is injected. The wellbore 14 has a wall 18 coated with a filter cake 20 deposited by a drilling fluid or, more commonly, a drill-in fluid or completion fluid 22. In some non-limiting embodiments, the filter cake 20 may be optional. The casing 10 and the wall 18 define an annulus 24 there between.

Figure 2:
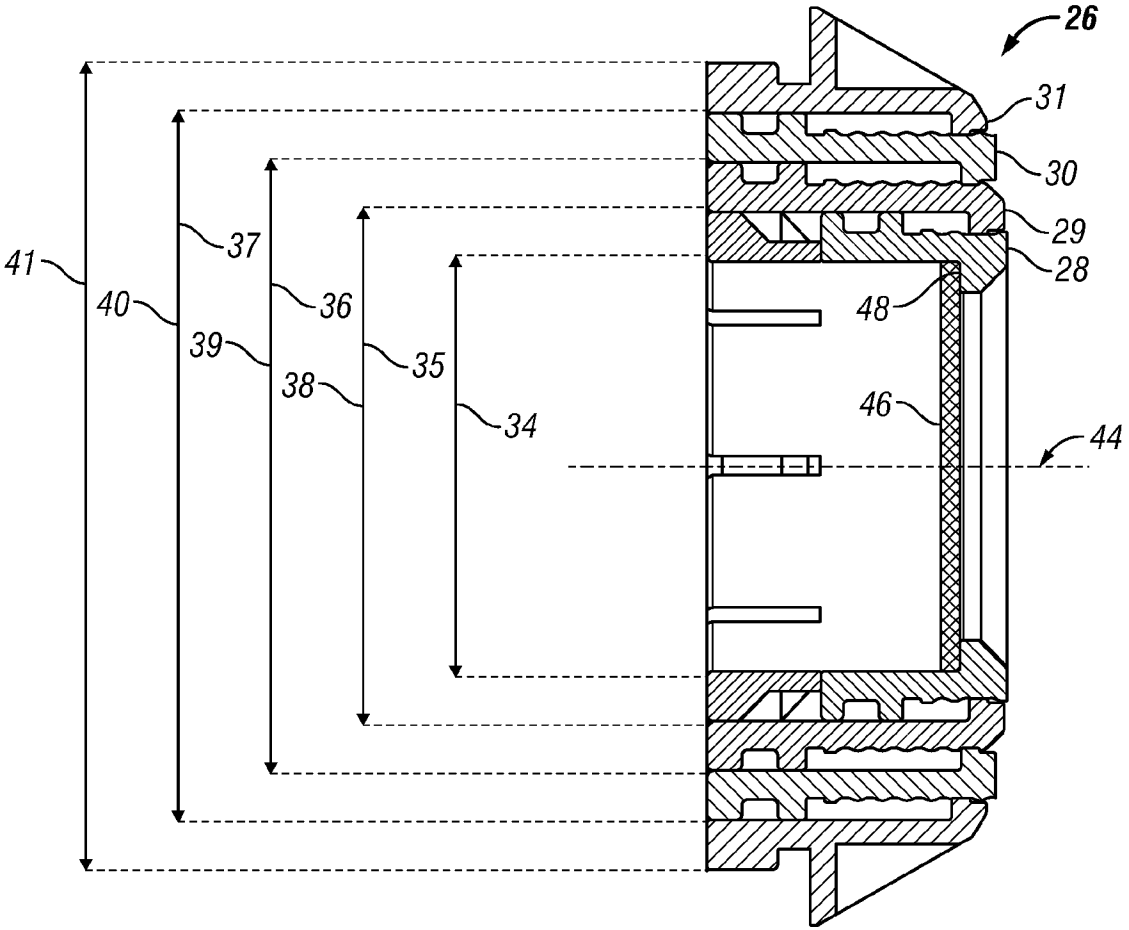
FIG. 2 is a cross-section schematic view of the telescoping conduit of FIG. 1.

Flow conduits 26 such as that shown in FIG. 2 may be disposed within the orifices 12. The flow conduits 26 are shown in FIG. 1 in a retracted position within the casing 10. The flow conduit 26 may be a series of sleeves 28-31 open on opposing ends having an enveloping wall defining their shape. It should be understood that although the exemplary flow conduit 26 is made up of four sleeves 28-31, any number of sleeves may be used in accordance with a present embodiment. In the exemplary embodiment, the sleeves 28-31 are generally cylindrical and have different internal diameters 34-37 and external diameters 38-41. The sleeves 28-31 may be arranged concentrically with respect to one another along a common axis 44 such that the first sleeve 28 having internal diameter 34 and external diameter 38 is disposed within the second sleeve 29 having internal radius diameter 35 and external diameter 39, which in turn is disposed within the third sleeve 30 having internal diameter 36 and external diameter 40, which is further disposed within the fourth sleeve 31 having internal diameter 37 and external diameter 41. Further, each sleeve 28-31 may be moveable with respect to the other sleeves 28-31 along the axis 44.

The flow conduits 26 contain temporary plugs 46 made of a soluble substance having low permeability and high strength. For example, the plug 46 may be Indiana limestone having an acid solubility greater than 70% and permeability of less than 10 mD. Although the present disclosure refers to the soluble substance of the plugs 46 as limestone, it should be understood that other materials having similar solubility, permeability, and strength may be utilized in the disclosed methods and systems. In a non-limiting embodiment, the plug 46 may be pre-formed and secured within one or more of the sleeves 28-31. For example, the plug 46 may be inserted into the sleeve 28 and abutted against the inside of a flange 48. In other embodiments, the plug 46 may be force fit into one or more of the sleeves 28-31 or disposed at an end of one of the sleeves 28-31 via a threaded hollow cap.

Figure 3:
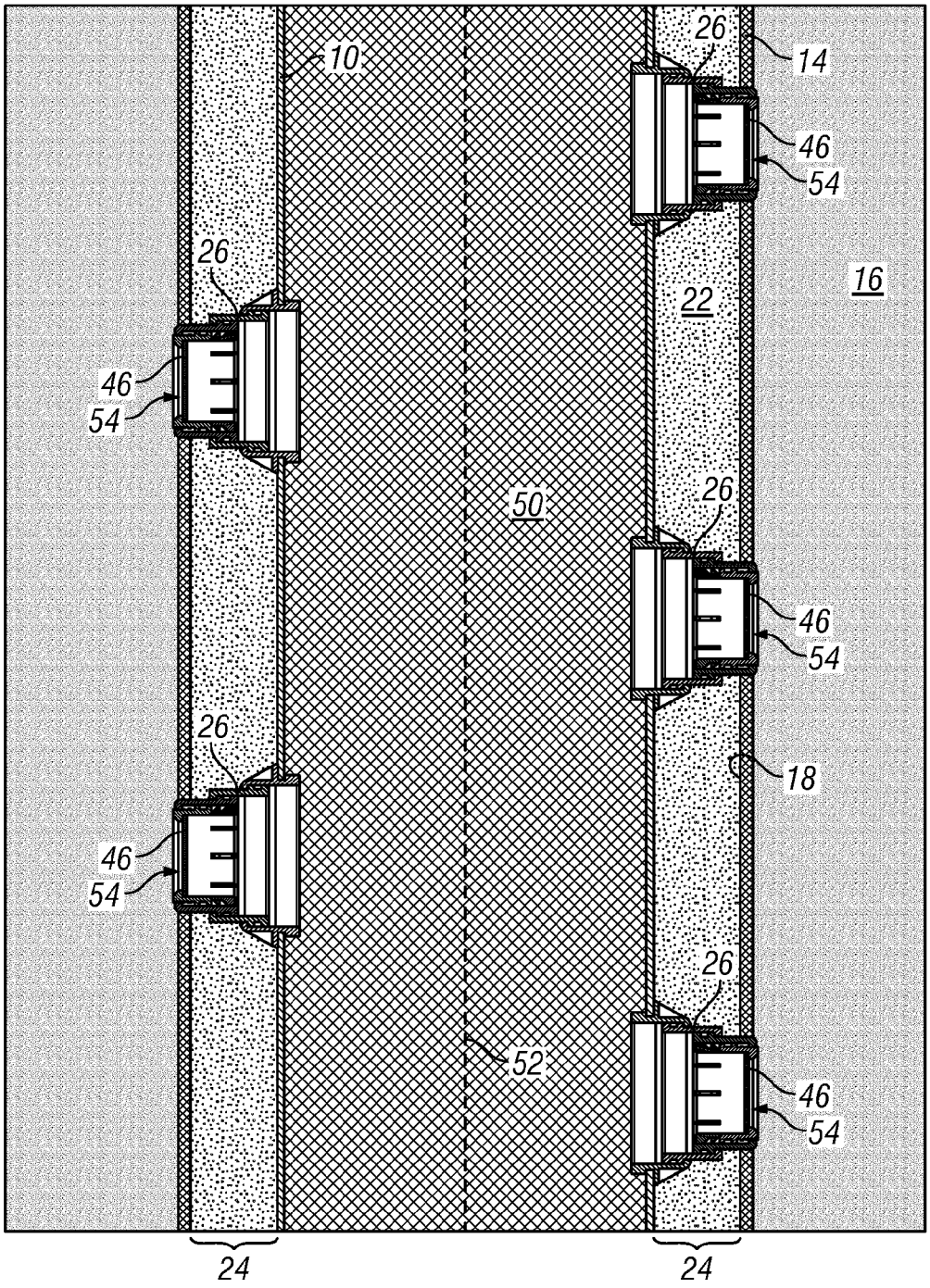
FIG. 3 is a cross-section schematic view of the oil well casing of FIG. 1 having a plurality of telescoping conduits therein, where the conduits have been extended or expanded in the direction of the wellbore wall.

Once the casing 10 is placed or positioned in the wellbore 14, a fluid 50 may be pumped through the casing 10 and the conduits 26, as shown in FIG. 3. As noted above, the plugs 46 within the conduits 26 have a very low permeability; accordingly, flow of the fluid 50 through the plugs may be substantially or completely inhibited. As the fluid 50 is pumped into the casing 10, enough hydraulic pressure is built up to extend the flow conduits 26 radially outward from the casing 10 into the annulus 22, such that the flow conduits 26 may be in contact with the producing formation 16. That is, the conduits 26 may be extended out from the casing 10 in a direction generally perpendicular to a longitudinal axis 52 of the casing 10. The hydraulic pressure of the fluid 50 typically causes the conduits 26 to extend to a position in which the conduits 26 touch or nearly touch the wall 18.

An acidic solution, such as dicarboxylic acid, may then be pumped into the casing 10 to dissolve the plugs 46, thereby forming flow paths 54 through the annulus 24 between the casing 10 and the formation 16, as shown in FIG. 3. The acidic solution may also dissolve the portions of the filter cake 20 (if present) with which it comes into contact. Fracturing fluids containing proppants may then be flowed through the casing 10 at high pressure to fracture the formation 16 in accordance with techniques well known in the art. Because the limestone plugs 46 may be substantially removed and do not leave behind a porous substrate to act as a filter, the proppants, such as grains of sand or the like, are not hindered from flowing into the fractures (not shown) created in formation 16.

In a non-limiting embodiment, the fluid 50 used to extend the conduits 26 may also be utilized to dissolve the plugs 46. That is, the fluid 50 may be an acidic solution having a low enough chemical reaction rate with the limestone plugs 46 that the plugs 46 begin slowly dissolving while the hydraulic pressure of the extension fluid 50 pushes the conduits 26 outward toward the wellbore wall 18. After the conduits 26 are extended out to touch the face of the reservoir 16, the acidic fluid 50 may continue to be pumped into the casing 10 to substantially dissolve the plugs 46. It should be understood that the method herein is considered successful if the plugs 46 dissolve sufficiently to open up the flow conduits 26 enough to enable flow of viscous fracturing fluids and proppants therethrough.

Figure 4:
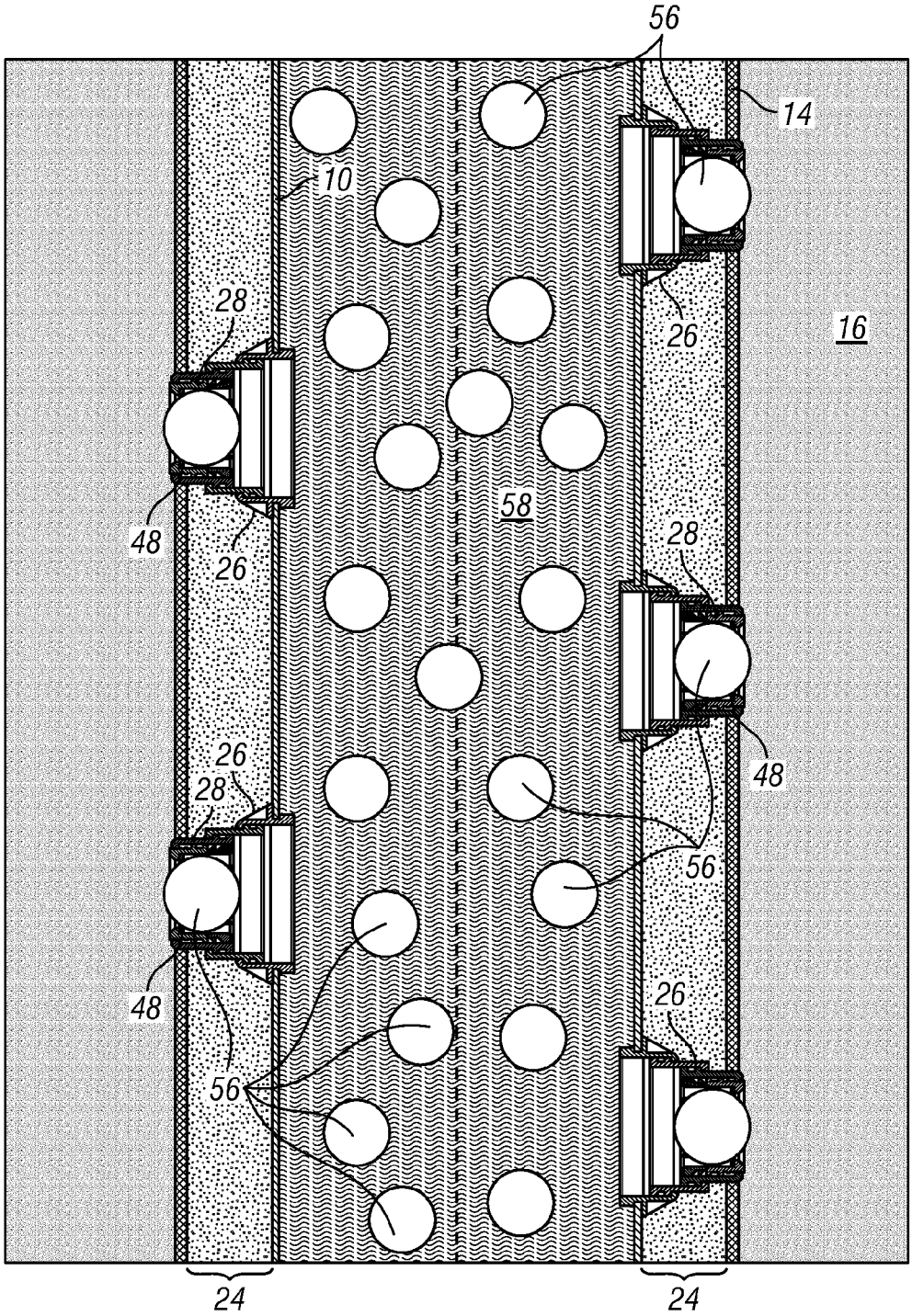
FIG. 4 is a cross-section schematic view of the oil well casing of FIG. 1 having a plurality of telescoping conduits therein, where the plugs in the conduits have been removed and porous objects have been introduced into the casing and the conduits.

After the well is fractured, porous objects 56 may be introduced into the casing 10 and pumped into the fluid conduits 26 via a pressurized fluid flow, as illustrated in FIG. 4. After the porous objects 56 are propagated throughout the casing 10 into the fluid conduits 26, the well may be produced. For instance, hydrocarbons may flow through the fluid conduits 26 from the formation 16 into the casing 10, through the fluid conduits 26, and into the formation 16.

In an exemplary embodiment, the porous objects 56 may be generally spherical balls having a diameter approximately equivalent to that of the inner diameter 34 of the sleeve 28. The balls may be composed of numerous beads (not shown) joined together to form the porous objects 56. That is, high-strength beads (i.e., stainless steel, alloy, ceramic, and the like) may be bonded together via, for example, sintering or gluing, to form the generally spherical porous balls 56. The beads may, in one embodiment, be from about 10 mesh (2000 μm) to about 100 mesh (149 μm). Additionally, the beads may be a generally uniform size or may be a variety of sizes.

In a non-limiting embodiment, the porous objects 56 may be carried into the extended flow conduits 26 via a flush fluid 58, such as, for example, brine, potassium chloride solution, non-crosslinked polymer fluid, diesel, foam, or the like. The flush fluid 58 may be pumped through the casing 10 and into the flow conduits 26 with sufficient force to push the porous objects 56 into the fluid conduits 26. The porous objects 56 may be blocked from escaping the flow conduits 26 by the flanges 48 in the sleeves 28.

Figure 5:
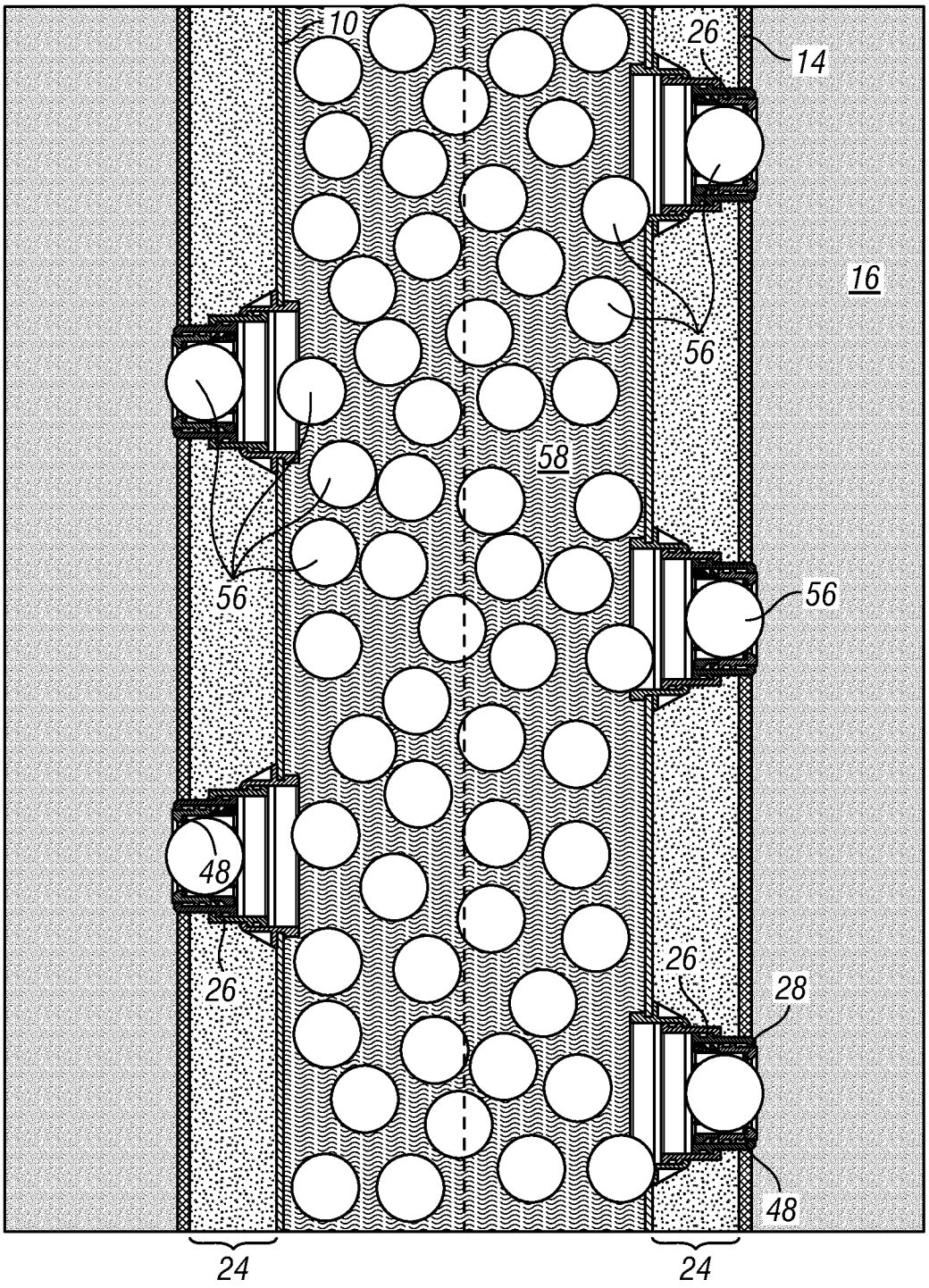
FIG. 5 is a cross-section schematic view of the oil well casing of FIG. 1 having a plurality of telescoping conduits therein, where the conduits have been fully extended and have the porous objects of FIG. 4 disposed therein.
Figure 7:
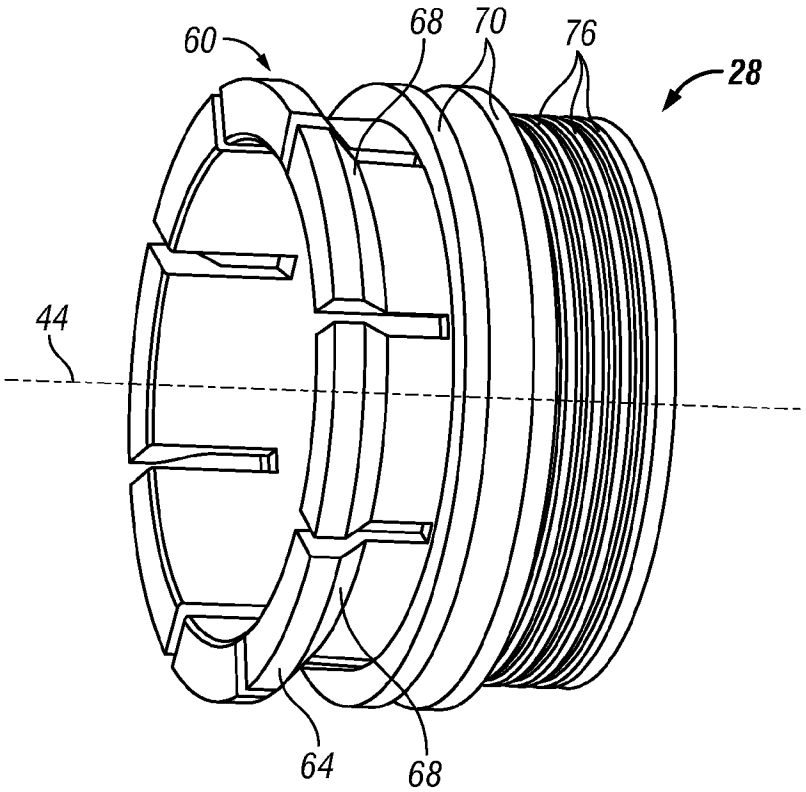
FIG. 7 is a perspective view of a sleeve of the telescoping conduit of FIG. 1 having collet fingers with tabs.
Figure 6:
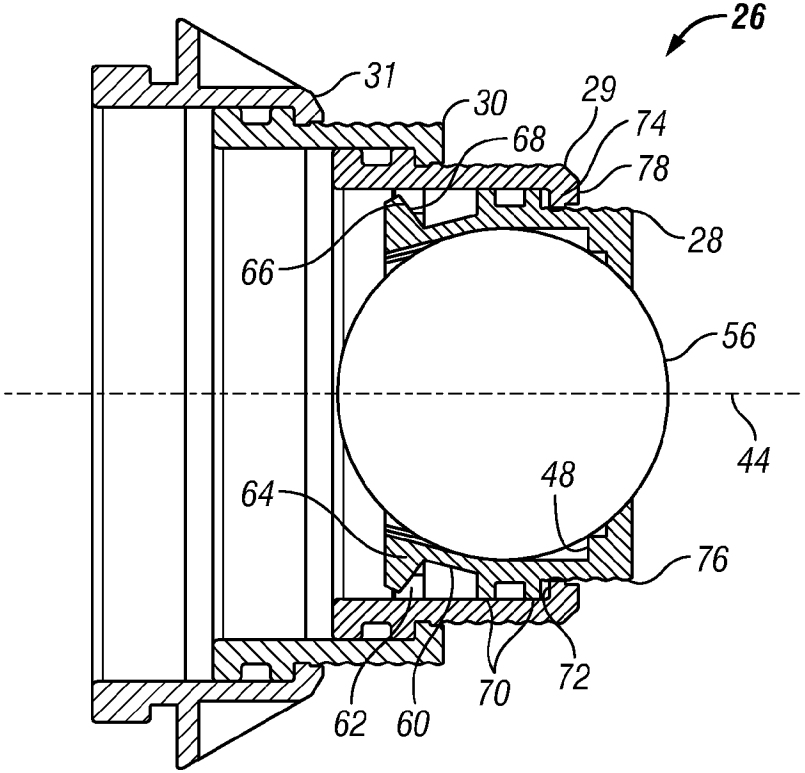
FIG. 6 is a cross-section schematic view of the telescoping conduit of FIG. 1 in a fully extended position.

As the flush fluid 58 continues to flow into the casing 10 of FIG. 4, a high pressure differential may be generated within the casing 10 relative to the annulus 24, thereby further extending the flow conduits 26 radially outward toward the formation 16, as illustrated in FIG. 5. When the sleeve 28 moves relative to the sleeve 29, collets 60 on the sleeve 28 may be actuated by contact with a flange 62 on the sleeve 29. As better illustrated in FIGS. 5 and 6, tabs 64 on the collets 60 may abut the flange 62. As the sleeve 28 moves radially outward from the casing 10 along the axis 44 relative to the sleeve 29, an angled surface 66 on the flange 62 may come into contact with complimentarily angled surfaces 68 on the tabs 64. With additional pressure inside the casing 10, a sufficient force may be generated to push the sleeve 28 still farther out relative to the sleeve 29. As the angled surface 66 of the flange 62 moves past the angled surface 68 of the tab 64, the force exerted radially inward toward the axis 44 may be such that the collets 60 are bent inward. When the collets 60 bend inward, the porous objects 56 may become trapped within the sleeve 28 between the flange 48 and the collets 60.

Further features of the sleeve 28 include one or more tabs 70 protruding radially outward from the exterior of the sleeve 28. These tabs 70 cooperate with an internal surface 72 of a flange 74 protruding radially inward from the interior of the sleeve 29. Abutment of the tabs 70 with the flange 74 limits movement of the sleeve 28 relative to the sleeve 29.

In addition, concentric rings 76 protrude radially outward from the exterior of the sleeve 28. These rings 76 may have a buttress-type profile wherein the leading edge of each ring 76 is beveled, for example, at about 30 degrees relative to the exterior of the sleeve 28, and the trailing edge is generally perpendicular to the exterior of the sleeve 28. When flow conduit 26 telescopes outward, the sleeve 28 moves along the axis 44 relative to the sleeve 29, and the beveled edges of the rings 76 move past the internal surface 72 of the flange 74. The perpendicular edge of the rings 76 then abuts an external surface 78 of the flange 74, thereby blocking the sleeve 28 from moving the opposite direction along the axis 44 relative to the sleeve 29.

The tabs 70 and rings 76 on the sleeve 28 cooperate with the flange 74 on the sleeve 29 to enable limited movement of the sleeve 28 relative to the sleeve 29 in only one direction along the axis 44. That is, when the sleeve 28 is expanded outward from the sleeve 29 along the axis 44, the flange 74 essentially locks the sleeve 28 in place by limiting movement in one direction via abutment with the tabs 70 and in the other direction via abutment with the trailing edge of the rings 76. The sleeves 29-31 may include similar features to enable telescopic expansion and prevent collapse of the flow conduit 26.

CONCLUSION

It will be evident that various modifications and changes may be made to the foregoing specification without departing from the broader spirit or scope of the invention as set forth in the appended claims. Accordingly, the specification is to be regarded in an illustrative rather than a restrictive sense. For example, specific materials, fluids, acidic solutions, and combinations thereof falling within the claimed parameters, but not specifically identified or tried in a particular composition, are anticipated to be within the scope of this invention. Additionally, various components and methods not specifically described herein may still be encompassed by the following claims.

The words "comprising" and "comprises" as used throughout the claims is to be interpreted as "including but not limited to". The present invention may suitably comprise, consist of, or consist essentially of the elements disclosed and may be practiced in the absence of an element not disclosed. For example, in one non-limiting embodiment, a pipe used in well completions may consist of or alternatively consist essentially of an interior space, an outer surface, at least one flow conduit and a porous object disposed within the flow conduit, as described in the claims.

The invention claimed is:

1. A method for hydraulic fracturing within a subterranean reservoir, wherein the subterranean reservoir has a wellbore therethrough, and the wellbore has positioned within the wellbore a pipe comprising:

an interior space;

an outer surface; and at least one telescoping flow conduit between the interior space and the outer surface, where the flow conduit bears within the flow conduit a porous object;

the method comprising:

applying hydraulic pressure via an extension fluid within the interior space of the pipe and the flow conduit to extend the telescoping flow conduit in the direction of the wellbore wall;

injecting a fracturing fluid into the subterranean reservoir via the interior space of the pipe and the telescoping flow conduit; and introducing the porous object into the telescoping flow conduit after injecting the fracturing fluid into the subterranean reservoir.

2. The method of claim 1, wherein the porous object comprises a generally spherical ball.

3. The method of claim 1, wherein the porous object comprises a plurality of beads joined together.

4. The method of claim 3, wherein the beads comprise stainless steel, alloy, ceramic, or a combination thereof.

5. The method of claim 3, wherein the beads have a mean size from about 10 mesh to about 100 mesh.

6. The method of claim 3, wherein the beads are sintered or glued together.

7. The method of claim 1, wherein the telescoping flow conduit bears within the telescoping flow conduit an acid-soluble plug and the method comprises removing the acid-soluble plug from the flow conduit via an acidic solution to at least partially open the flow conduit before injecting the fracturing fluid into the subterranean reservoir.

8. The method of claim 7, wherein the acid-soluble plug comprises a material having an acid solubility greater than 70% and permeability of less than 10 mD.

9. The method of claim 7, wherein the acid-soluble plug comprises a limestone plug.

10. The method of claim 1, wherein the pipe is selected from the group consisting of conductor pipe, casing, tubing, liner, and combinations thereof.

11. The method of claim 1, wherein the fracturing fluid comprises one or more proppant materials and the subterranean reservoir is a proppant-fractured reservoir.

12. The method of claim 11, comprising producing the proppant-fractured reservoir.

13. A system for use in well completions, comprising:

a pipe defined by a pipe wall, wherein the pipe has an interior space and an outer surface; and at least one telescoping flow conduit comprising:

a first sleeve comprising an enveloping wall and two open, opposing ends, where the first sleeve is disposed in the pipe wall between the interior space and the outer surface; and a second sleeve comprising an enveloping wall and first and second open, opposing ends, where the second sleeve is disposed within the first sleeve, is movable with respect to the first sleeve, and is configured to trap a porous ball therein; and wherein an acid-soluble plug is disposed within at least one of the first sleeve, the second sleeve, or combinations thereof, and wherein the acid-soluble plug comprises a material having an acid solubility greater than 70% and permeability of less than 10 mD, wherein the acid-soluble plug does not leave behind a porous substrate once the acid-soluble plug is dissolved.

14. The system of claim 13, wherein the porous ball comprises a plurality of beads joined together.

15. The system of claim 14, wherein the beads comprise stainless steel, alloy, ceramic, or a combination thereof.

16. The system of claim 14, wherein the beads have a mean size from about 10 mesh to about 100 mesh.

17. The system of claim 14, wherein the beads are sintered or glued together.

18. The system of claim 13, wherein the second sleeve comprises a protrusion extending into an interior of the sleeve from the enveloping wall proximal to the first open end, where the protrusion is configured to block the porous ball from passing through the first open end.

19. The method of claim 13, wherein the enveloping wall of the second sleeve comprises a plurality of collet fingers configured to deform inward in response to an external force on the collet fingers.

20. The system of claim 19, wherein the first sleeve and the second sleeve are configured to apply the external force to the collet fingers during movement of the second sleeve relative to the first sleeve.

21. The system of claim 13, wherein the pipe is selected from the group consisting of conductor pipe, casing, tubing, liner, and combinations thereof.

22. The system of claim 13, wherein the acid-soluble plug comprises a limestone plug.

23. A system for use in well completions, comprising:

a pipe defined by a pipe wall, wherein the pipe has an interior space and an outer surface; and at least one telescoping flow conduit comprising:

a first sleeve comprising an enveloping wall and two open, opposing ends, where the first sleeve is disposed in the pipe wall between the interior space and the outer surface; and a second sleeve comprising an enveloping wall and first and second open, opposing ends, where the second sleeve is disposed within the first sleeve, is movable with respect to the first sleeve, and is configured to trap a porous ball therein; and wherein an acid-soluble plug is disposed within at least one of the first sleeve, the second sleeve, or combinations thereof, and wherein the acid-soluble plug comprises a material having an acid solubility greater than 70% and permeability of less than 10 mD, wherein the acid-soluble plug is dissolvable by dicarboxylic acid.

* * * * *